US010617188B1

(12) United States Patent
Hooks

(10) Patent No.: US 10,617,188 B1
(45) Date of Patent: Apr. 14, 2020

(54) THEFT RESISTANT HANDBAG ASSEMBLY

(71) Applicant: Jerome M. Hooks, Pasadena, CA (US)

(72) Inventor: Jerome M. Hooks, Pasadena, CA (US)

( * ) Notice: Subject to any disclaimer, the term of this patent is extended or adjusted under 35 U.S.C. 154(b) by 0 days.

(21) Appl. No.: 16/260,257

(22) Filed: Jan. 29, 2019

(51) Int. Cl.

| | |
|---|---|
| ***A45C 13/22*** | (2006.01) |
| ***A45C 13/24*** | (2006.01) |
| ***A45C 3/06*** | (2006.01) |
| ***G08B 3/10*** | (2006.01) |
| ***A45C 13/18*** | (2006.01) |

(52) U.S. Cl.
CPC ..... *A45C 13/24* (2013.01); *A45C 3/06* (2013.01); *A45C 13/185* (2013.01); *A45C 13/22* (2013.01); *G08B 3/10* (2013.01)

(58) Field of Classification Search
CPC ..... A45C 13/20; A45C 13/30; A45C 13/24; A45C 13/18; G08B 13/149; G08B 13/1409; G08B 13/1445; G08B 21/0297
See application file for complete search history.

(56) References Cited

U.S. PATENT DOCUMENTS 2,927,311 A * 3/1960 Donaldson ..... A45C 13/24 340/571
3,851,326 A * 11/1974 Costa ..... A45C 13/24 340/571
4,162,695 A * 7/1979 Moses ..... A45C 13/18 150/102
4,728,937 A 3/1988 Hsu
4,908,606 A 3/1990 Kevonian
5,001,460 A 3/1991 Basson
5,281,953 A 1/1994 Torres
5,661,456 A 8/1997 Staehle
6,133,830 A * 10/2000 D'Angelo ..... G08B 13/1409 340/539.1
7,772,973 B2 8/2010 Shih

FOREIGN PATENT DOCUMENTS

WO WO2013056717 4/2013

* cited by examiner

*Primary Examiner* — Benyam Haile

(57) ABSTRACT

A theft resistant handbag assembly for thwarting purse snatchers includes a shell, a trigger, and an antitheft module, which is operationally coupled to an actuator and comprises an alarm and a heater. The shell, which defines an interior space, has a top that is open. A handle that is coupled to the shell is configured for a user to carry the shell. A line is coupled to and extends between the trigger and a wrist strap, which is configured to position around a wrist of the user. Decoupling of the trigger, which is removably coupled to the actuator, activates the actuator. In an event the shell is snatched, the line is positioned to pull the trigger to decouple it from the actuator, positioning the actuator to actuate the alarm, to sound to draw attention to a purse snatcher, and the heater so that the purse snatcher drops the shell.

14 Claims, 5 Drawing Sheets

THEFT RESISTANT HANDBAG ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to handbag assemblies and more particularly pertains to a new handbag assembly for thwarting purse snatchers.

BRIEF SUMMARY OF THE INVENTION

An embodiment of the disclosure meets the needs presented above by generally comprising a shell, a trigger, and an antitheft module, which is operationally coupled to an actuator and comprises an alarm and a heater. The shell, which defines an interior space, has a top that is open. A handle that is coupled to the shell is configured for a user to carry the shell. A line is coupled to and extends between the trigger and a wrist strap, which is configured to position around a wrist of the user. Decoupling of the trigger, which is removably coupled to the actuator, activates the actuator. In an event the shell is snatched, the line is positioned to pull the trigger to decouple it from the actuator, positioning the actuator to actuate the alarm, to sound to draw attention to a purse snatcher, and the heater so that the purse snatcher drops the shell.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
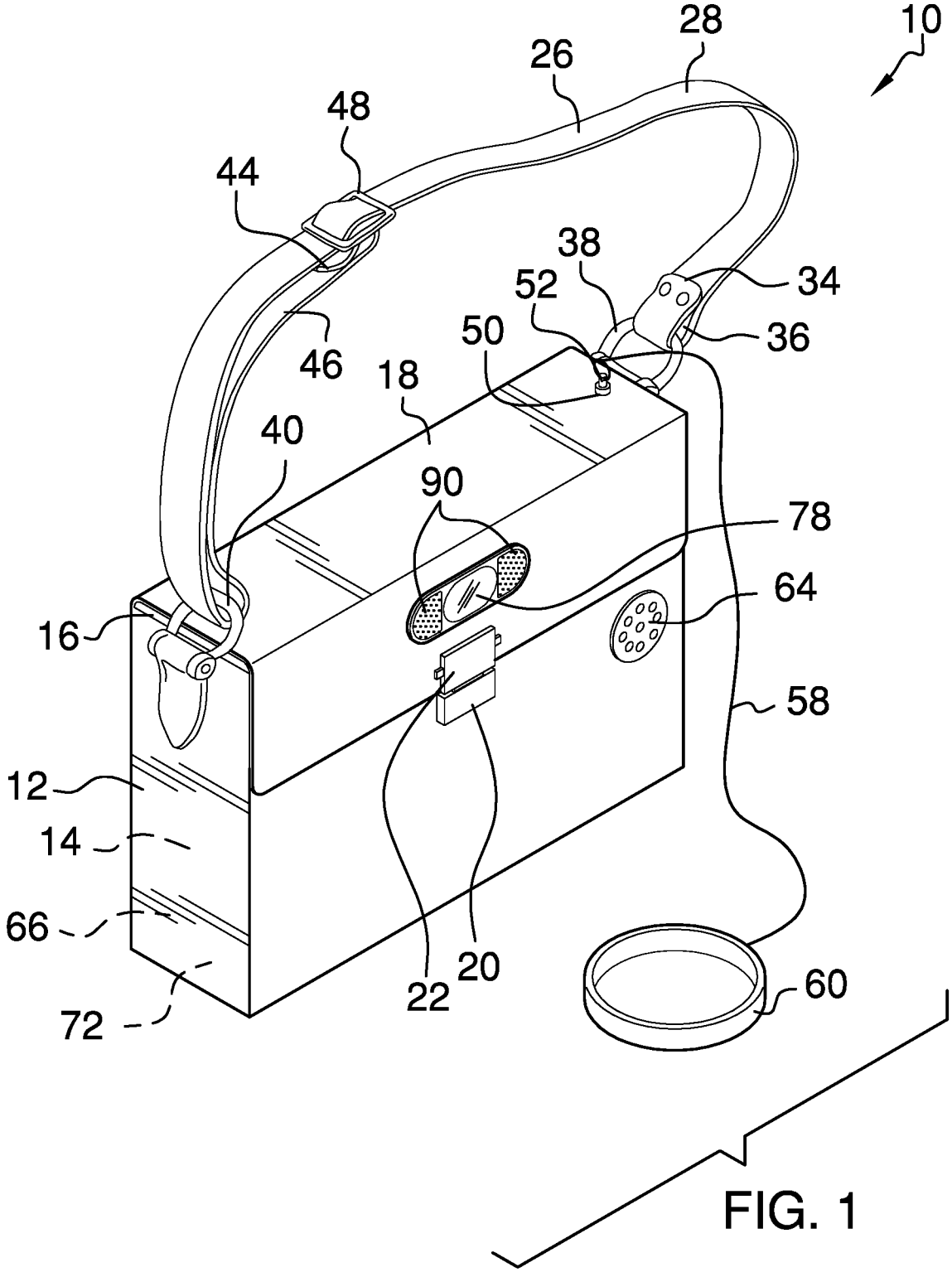
FIG. 1 is an isometric perspective view of a theft resistant handbag assembly according to an embodiment of the disclosure.

With reference now to the drawings, and in particular to FIGS. 1 through 5 thereof, a new handbag assembly embodying the principles and concepts of an embodiment of the disclosure and generally designated by the reference numeral 10 will be described.

As best illustrated in FIGS. 1 through 5, the theft resistant handbag assembly 10 generally comprises a shell 12 that define an interior space 14. The shell 12 has a top 16 that is open. The shell 12 is substantially rectangularly box shaped. A lid 18 that is hingedly coupled to the shell 12 proximate to the top 16 is positioned to selectively close the top 16.

Figure 2:
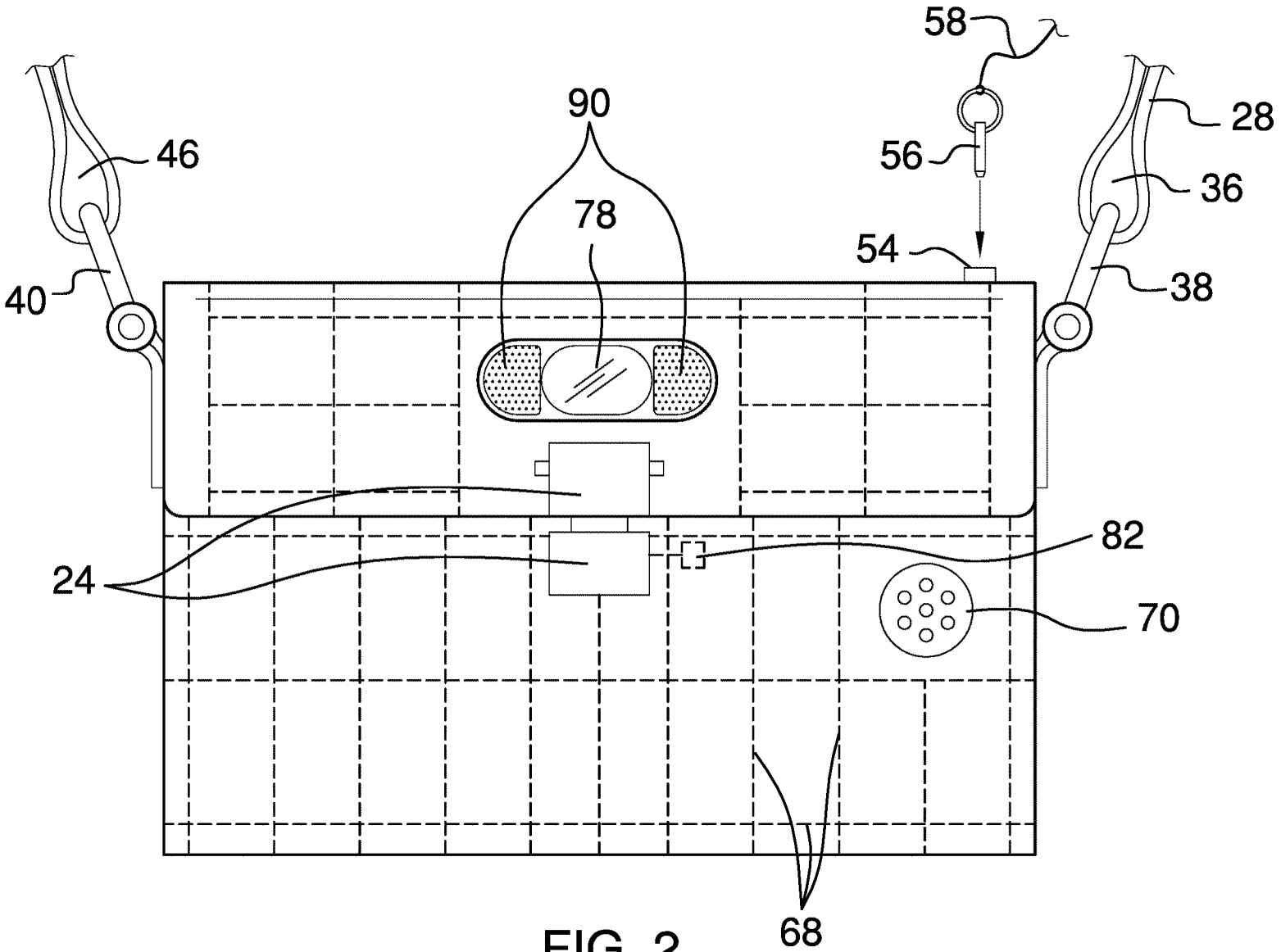
FIG. 2 is a front view of an embodiment of the disclosure.

A first fastener 20 is coupled to the shell 12. A second fastener 22 is coupled to the lid 18. The second fastener 22 is complementary to the first fastener 20. The second fastener 22 is positioned to selectively couple to the first fastener 20 to removably couple the lid 18 to the shell 12 to close the top 16. The second fastener 22 and the first fastener 20 comprises a clasp 24, as shown in FIG. 2.

Figure 4:
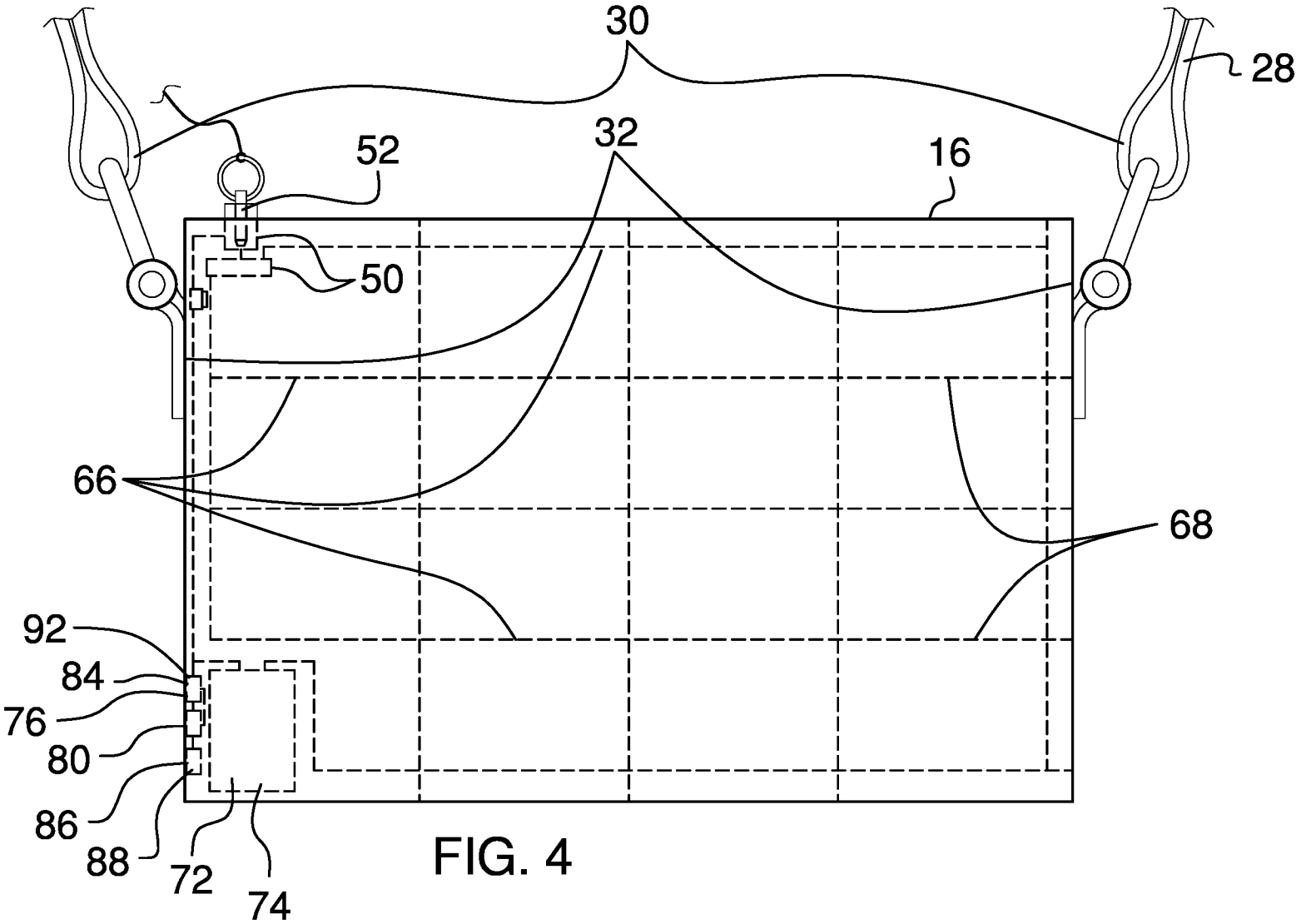
FIG. 4 is a back view of an embodiment of the disclosure.
Figure 5:
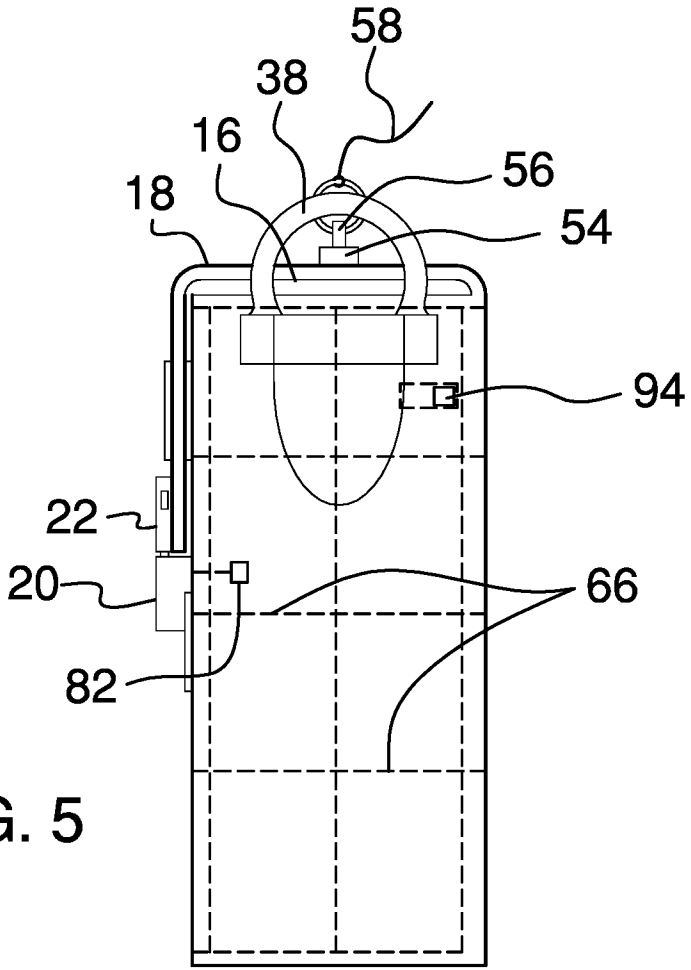
FIG. 5 is a side view of an embodiment of the disclosure.

A handle 26 that is coupled to the shell 12 is configured to be grasped in a hand of a user to carry the shell 12. The handle 26 comprises a purse strap 28 that has opposing ends 30, as shown in FIG. 1. Each opposing end 30 is coupled to a respective opposing side 32 of the shell 12 proximate to the top 16 of the shell 12 so that the purse strap 28 is configured to position over a shoulder of the user. The purse strap 28 has a first end 34 that is coupled to the purse strap 28 proximate to the first end 34 define a first loop 36, as shown in FIG. 4.

The handle 26 also comprises first ring 38, a second ring 40, and a coupler 42. The first ring 38 and the second ring 40 are pivotally coupled, singly, to the opposing sides 32 of the shell 12 proximate to the top 16. The first ring 38 is positioned through the first loop 36 so that the purse strap 28 is coupled to the first ring 38. The purse strap 28 extends through the second ring 40. The coupler 42 is slidably coupled to the purse strap 28 and is selectively couplable to the purse strap 28 by inserting a second end 44 of the purse strap 28 into the coupler 42, as shown in FIG. 1, so that the purse strap 28 is coupled to the second ring 40. The coupler 42 is configured to be slid on the purse strap 28 so that a second loop 46, which extends between the second ring 40 and the coupler 42, is selectively sizable for fitting the purse strap 28 to the user. The coupler 42 comprises a buckle 48.

An actuator 50 is coupled to the shell 12. A trigger 52 is removably coupled to the actuator 50 so that decoupling of the trigger 52 from the actuator 50 activates the actuator 50. The actuator 50 comprises a port 54 and the trigger 52 comprises a pin 56, as shown in FIG. 2. Extraction of the pin 56 from the port 54 activates the actuator 50 and insertion of the pin 56 into the port 54 deactivates the actuator 50.

A line 58 is coupled to and extends from the trigger 52. A wrist strap 60 is coupled to the line 58 distal from the trigger 52. The wrist strap 60 is configured to position around a wrist of the user to tether the shell 12 to the user.

An antitheft module 62 is coupled to the shell 12 and is positioned in the interior space 14. The antitheft module 62 is operationally coupled to the actuator 50. The antitheft module 62 comprises an alarm 64 and a heater 66. In an event the shell 12 is snatched, the line 58 is positioned to pull the trigger 52 so that the trigger 52 is decoupled from the actuator 50, positioning the actuator 50 to actuate the alarm 64 and the heater 66. The alarm 64 is configured to sound to draw attention to a purse snatcher. The heater 66 is configured to heat the shell 12 so that the purse snatcher drops the shell 12.

Figure 3:
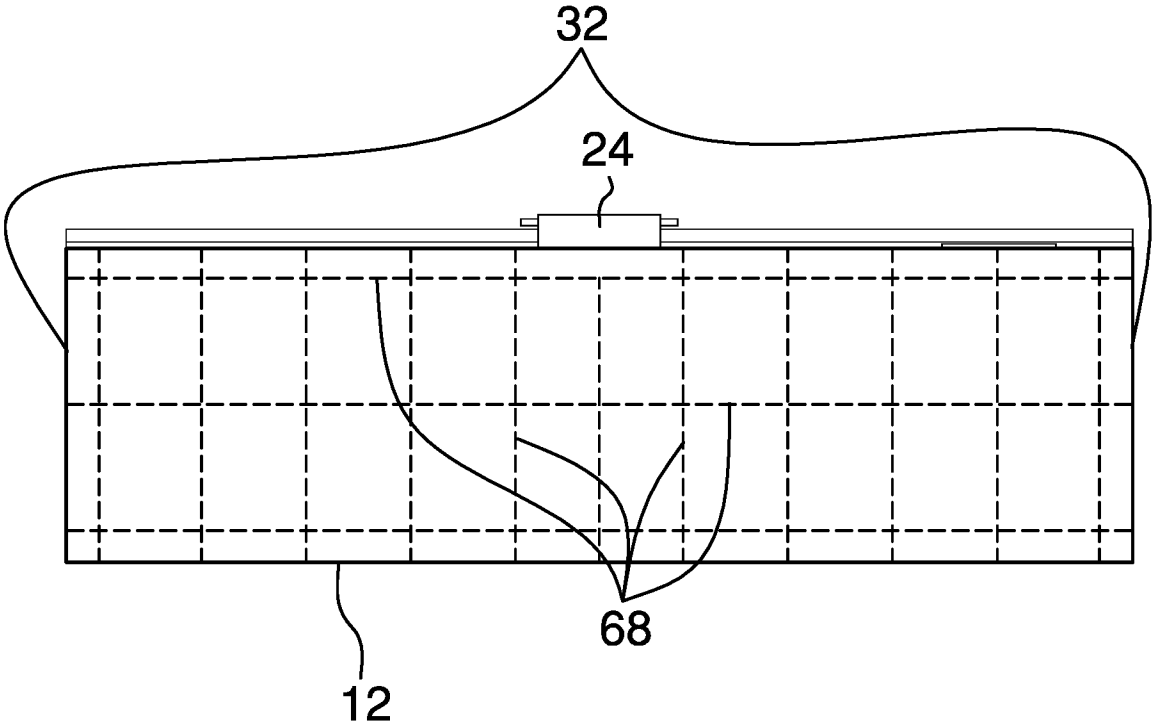
FIG. 3 is a bottom view of an embodiment of the disclosure.

The heater 66 comprises a plurality of heating elements 68 that is embedded in the shell 12, as shown in FIG. 3. The alarm 64 comprises a first speaker 70, as shown in FIG. 2. In addition to the heater 66 and the alarm 64, the antitheft module 62 also comprises a power module 72, which comprises a battery 74, and a microprocessor 76. The microprocessor 76 is operationally coupled to the power module 72, the actuator 50, the heater 66, and the alarm 64. The actuator 50 is positioned to signal the microprocessor 76 in event of decoupling of the trigger 52, positioning the microprocessor 76 to actuate the alarm 64 to draw attention to the purse snatcher and to actuate the heater 66 so that the shell 12 becomes hot and the purse snatcher drops the shell 12.

A clock 78 is coupled to the lid 18 and is operationally coupled to the microprocessor 76. The clock 78 is configured to display a current time to the user. A receiver 80 is coupled to the shell 12 and positioned in the interior space 14. The receiver 80 is operationally coupled to the microprocessor 76. The receiver 80 is configured to receive a global positioning system time signal, positioning the microprocessor 76 to correct the current time displayed to the user.

A sensor 82 is coupled to the shell 12 proximate to the first fastener 20. The sensor 82 is operationally coupled to the microprocessor 76 and is positioned to signal the microprocessor 76 when the second fastener 22 is decoupled from the first fastener 20. Timing programming code 84 is positioned on the microprocessor 76 so that the microprocessor 76 is programmed to actuate the receiver 80 when the lid 18 is opened. The current time displayed on the clock 78 is thus updated each time the lid 18 is opened.

A data storage module 86 is coupled to the shell 12 and is positioned in the interior space 14. The data storage module 86 is operationally coupled to the microprocessor 76 and is configured to store a plurality of audio files 88.

A plurality of second speakers 90 is coupled to the lid 18 and is operationally coupled to the microprocessor 76. The microprocessor 76 is positioned to selectively actuate the plurality of second speakers 90 to broadcast a respective audio file 88 in event the second fastener 22 is decoupled from the first fastener 20. Greeting programming code 92 is positioned on the microprocessor 76 so that the microprocessor 76 is programmed to actuate the data storage module 86, when the lid 18 is opened, to relay a respective audio file 88, which is matched to the current time, to the plurality of second speakers 90 to broadcast the respective audio file 88 to the user. For example, in the morning, afternoon, and evening, a pleasant female voice may be broadcast stating "good morning", "good afternoon", and "good evening", respectively.

A power switch 94 is coupled to an interior surface of the shell 12 proximate to the top. The power switch 94 is operationally coupled to the microprocessor 76 and the power module 72. The power switch 94 is configured to selectively signal the microprocessor 76 to deactivate the antitheft module 62 and the plurality of second speakers 90.

In use, the shell is configured to be utilized as a standard purse except that the shell 12 is tethered to the user via the line 58 and the wrist strap 60. In event of decoupling of the trigger 52, as would occur in a purse snatching, the microprocessor 76 is positioned to actuate the alarm 64 to draw attention to the purse snatcher and to actuate the heater 66 so that the shell 12 becomes hot and the purse snatcher drops the shell 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A theft resistant handbag assembly comprising:

a shell defining an interior space, the shell having a top, the top being open;

a lid hingedly coupled to the shell such that the lid is positioned for selectively closing the top;

a handle coupled to the shell wherein the handle is configured for grasping in a hand of a user for carrying the shell;

an actuator coupled to the lid such that the actuator is exposed on the lid, the actuator comprising a port extending into the lid;

a trigger removably coupled to the actuator such that decoupling of the trigger from the actuator activates the actuator, the trigger comprising a pin wherein extraction of the pin from the port activates the actuator and wherein insertion of the pin into the port deactivates the actuator;

a line coupled to and extending from the trigger;

a wrist strap coupled to the line distal from the trigger wherein the wrist strap is configured for positioning around a wrist of the user for tethering the shell to the user;

an antitheft module coupled to the shell and positioned in the interior space, the antitheft module being operationally coupled to the actuator, the antitheft module comprising an alarm and a heater such that, in an event the shell is snatched, the line is positioned for pulling the trigger such that the trigger is decoupled from the actuator positioning the actuator for actuating the alarm and the heater wherein the alarm is configured for sounding for drawing attention to a purse snatcher and wherein the heater is configured for heating the shell such that the purse snatcher drops the shell;

the antitheft module comprising:

a power module; and a microprocessor operationally coupled to the power module, the actuator, the heater, and the alarm wherein the actuator is positioned for signaling the microprocessor in event of decoupling of the trigger, positioning the microprocessor for actuating the alarm for drawing attention to the purse snatcher and for actuating the heater such the shell becomes hot and the purse snatcher drops the shell;

a clock coupled to the lid, the clock being operationally coupled to the microprocessor wherein the clock is configured for displaying a current time to the user.

2. The assembly of claim 1, further including the shell being rectangularly box shaped.

3. The assembly of claim 1, further comprising:

a first fastener coupled to the shell; and a second fastener coupled to the lid, the second fastener being complementary to the first fastener wherein the second fastener is positioned for selectively coupling to the first fastener for removably coupling the lid to the shell for closing the top.

4. The assembly of claim 3, further including the second fastener and the first fastener comprising a clasp.

5. The assembly of claim 1, further including the handle comprising a purse strap having opposing ends, each opposing end being coupled to a respective opposing side of the shell wherein the purse strap is configured for positioning over a shoulder of the user.

6. The assembly of claim 5, further comprising:

the purse strap having a first end, the first end being coupled to the purse strap defining a first loop;

a first ring and a second ring, the first ring and the second ring being pivotally coupled singly to the opposing sides of the shell, the first ring being positioned through the first loop such that the purse strap is coupled to the first ring, the purse strap extending through the second ring; and a coupler slidably coupled to the purse strap, the coupler being selectively couplable to the purse strap by inserting a second end of the purse strap into the coupler so that the purse strap is coupled to the second ring wherein the coupler is configured to be slid on the purse strap so that a second loop, which extends between the second ring and the coupler, is selectively sizable for fitting the purse strap to the user.

7. The assembly of claim 6, further including the coupler comprising a buckle.

8. The assembly of claim 1, further comprising:

the heater comprising a plurality of heating elements embedded in the shell; and the alarm comprising a first speaker.

9. The assembly of claim 1, further including the power module comprising a battery.

10. The assembly of claim 1, further including a receiver coupled to the shell and positioned in the interior space, the receiver being operationally coupled to the microprocessor wherein the receiver is configured for receiving a global positioning system time signal, positioning the microprocessor for correcting the current time displayed to the user.

11. The assembly of claim 10, further comprising:

a first fastener coupled to the shell;

a second fastener coupled to the lid, the second fastener being complementary to the first fastener wherein the second fastener is positioned for selectively coupling to the first fastener for removably coupling the lid to the shell for closing the top;

a sensor coupled to the shell, the sensor being operationally coupled to the microprocessor wherein the sensor is positioned for signaling the microprocessor when the second fastener is decoupled from the first fastener; and timing programming code positioned on the microprocessor wherein the microprocessor is programmed for actuating the receiver when the lid is opened.

12. The assembly of claim 11, further including comprising:

a data storage module coupled to the shell and positioned in the interior space, the data storage module being operationally coupled to the microprocessor wherein the data storage module is configured for storing a plurality of audio files;

a plurality of second speakers coupled to the lid, the plurality of second speakers being operationally coupled to the microprocessor wherein the microprocessor is positioned for selectively actuating the plurality of second speakers for broadcasting a respective audio file in event the second fastener is decoupled from the first fastener; and greeting programming code positioned on the microprocessor wherein the microprocessor is programmed for actuating the data storage module, when the lid is opened, for relaying a respective audio file matched to the current time to the plurality of second speakers for broadcasting the respective audio file to the user.

13. The assembly of claim 12, further including a power switch coupled to an interior surface of the shell proximate to the top, the power switch being operationally coupled to the microprocessor and the power module wherein power switch is configured for selectively signaling the microprocessor for deactivating the antitheft module and the plurality of second speakers.

14. A theft resistant handbag assembly comprising:

a shell defining an interior space, the shell having a top, the top being open, the shell being rectangularly box shaped;

a lid hingedly coupled to the shell wherein the lid is positioned for selectively closing the top;

a first fastener coupled to the shell;

a second fastener coupled to the lid, the second fastener being complementary to the first fastener wherein the second fastener is positioned for selectively coupling to the first fastener for removably coupling the lid to the shell for closing the top, the second fastener and the first fastener comprising a clasp;

a handle coupled to the shell wherein the handle is configured for grasping in a hand of a user for carrying the shell, the handle comprising a purse strap having opposing ends, each opposing end being coupled to a respective opposing side of the shell proximate to the top of the shell wherein the purse strap is configured for positioning over a shoulder of the user, the purse strap having a first end, the first end being coupled to the purse strap defining a first loop;

a first ring and a second ring, the first ring and the second ring being pivotally coupled singly to the opposing sides of the shell, the first ring being positioned through the first loop such that the purse strap is coupled to the first ring, the purse strap extending through the second ring;

a coupler slidably coupled to the purse strap, the coupler being selectively couplable to the purse strap by inserting a second end of the purse strap into the coupler so that the purse strap is coupled to the second ring wherein the coupler is configured to be slid on the purse strap so that a second loop, which extends between the second ring and the coupler, is selectively sizable for fitting the purse strap to the user, the coupler comprising a buckle;

an actuator coupled to the lid such that the actuator is exposed on the lid, the actuator comprising a port extending into the lid;

a trigger removably coupled to the actuator such that decoupling of the trigger from the actuator activates the actuator, the trigger comprising a pin wherein extraction of the pin from the port activates the actuator and wherein insertion of the pin into the port deactivates the actuator;

a line coupled to and extending from the trigger;

a wrist strap coupled to the line distal from the trigger wherein the wrist strap is configured for positioning around a wrist of the user for tethering the shell to the user;

an antitheft module coupled to the shell and positioned in the interior space, the antitheft module being operationally coupled to the actuator, the antitheft module comprising an alarm and a heater such that, in an event the shell is snatched, the line is positioned for pulling the trigger such that the trigger is decoupled from the actuator positioning the actuator for actuating the alarm and the heater wherein the alarm is configured for sounding for drawing attention to a purse snatcher and wherein the heater is configured for heating the shell such that the purse snatcher drops the shell, the heater comprising a plurality of heating elements embedded in the shell, the alarm comprising a first speaker, the antitheft module comprising:

a power module, the power module comprising a battery, and a microprocessor operationally coupled to the power module, the actuator, the heater, and the alarm wherein the actuator is positioned for signaling the microprocessor in event of decoupling of the trigger, positioning the microprocessor for actuating the alarm for drawing attention to the purse snatcher and for actuating the heater such the shell becomes hot and the purse snatcher drops the shell;

a clock coupled to the lid, the clock being operationally coupled to the microprocessor wherein the clock is configured for displaying a current time to the user;

a receiver coupled to the shell and positioned in the interior space, the receiver being operationally coupled to the microprocessor wherein the receiver is configured for receiving a global positioning system time signal, positioning the microprocessor for correcting the current time displayed to the user;

a sensor coupled to the shell proximate to the first fastener, the sensor being operationally coupled to the microprocessor wherein the sensor is positioned for signaling the microprocessor when the second fastener is decoupled from the first fastener;

timing programming code positioned on the microprocessor wherein the microprocessor is programmed for actuating the receiver when the lid is opened;

a data storage module coupled to the shell and positioned in the interior space, the data storage module being operationally coupled to the microprocessor wherein the data storage module is configured for storing a plurality of audio files;

a plurality of second speakers coupled to the lid, the plurality of second speakers being operationally coupled to the microprocessor wherein the microprocessor is positioned for selectively actuating the plurality of second speakers for broadcasting a respective audio file in event the second fastener is decoupled from the first fastener;

greeting programming code positioned on the microprocessor wherein the microprocessor is programmed for actuating the data storage module, when the lid is opened, for relaying a respective audio file matched to the current time to the plurality of second speakers for broadcasting the respective audio file to the user; and a power switch coupled to an interior surface of the shell proximate to the top, the power switch being operationally coupled to the microprocessor and the power module wherein power switch is configured for selectively signaling the microprocessor for deactivating the antitheft module and the plurality of second speakers.

* * * * *